US006199863B1

(12) United States Patent
Chan

(10) Patent No.: US 6,199,863 B1
(45) Date of Patent: Mar. 13, 2001

(54) CUBES AND TRAY GAME SET WITH DISPLAY MEANS

(76) Inventor: Wai Man Chan, 704 Hougang Ave 2, #01-209, Singapore (SG), 530704

( * ) Notice: Subject to any disclaimer, the term of this patent is extended or adjusted under 35 U.S.C. 154(b) by 0 days.

(21) Appl. No.: 09/258,904

(22) Filed: Mar. 1, 1999

(51) Int. Cl.[7] ..... A63F 3/00

(52) U.S. Cl. ..... 273/236; 273/287; 273/282.3; 273/148 R; 273/272

(58) Field of Search ..... 273/272, 299, 273/282.1, 148 R, 153 R, 291, 287, 290, 282.3

(56) References Cited

U.S. PATENT DOCUMENTS 4,201,389 * 5/1980 Vowel .
4,244,580 * 1/1981 Hoyles .
5,314,191 * 5/1994 Mayas .

* cited by examiner

*Primary Examiner*—Benjamin H. Layno
*Assistant Examiner*—V K Mendiratta

(57) ABSTRACT

A board game set comprises a plurality of cubic game pieces which are having indicia on each face, a lattice-like game board having rows and columns of compartments which hold chosen game pieces for construction of either words, terms or phrases in either English or Chinese, mathematical or chemical expressions, etc., by the use of reflective display means in which all faces of game pieces placed are viewed in a glance. Each said reflective display means is provided for each player and is having two mirrors and a game piece orientation means for viewing the rear faces and bottom face of the game pieces.

6 Claims, 8 Drawing Sheets

Fig. 2a
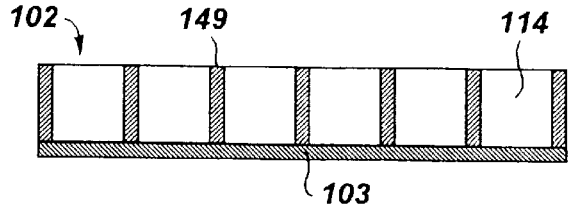
Fig. 2b
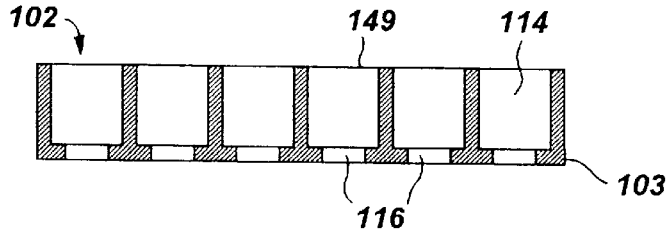
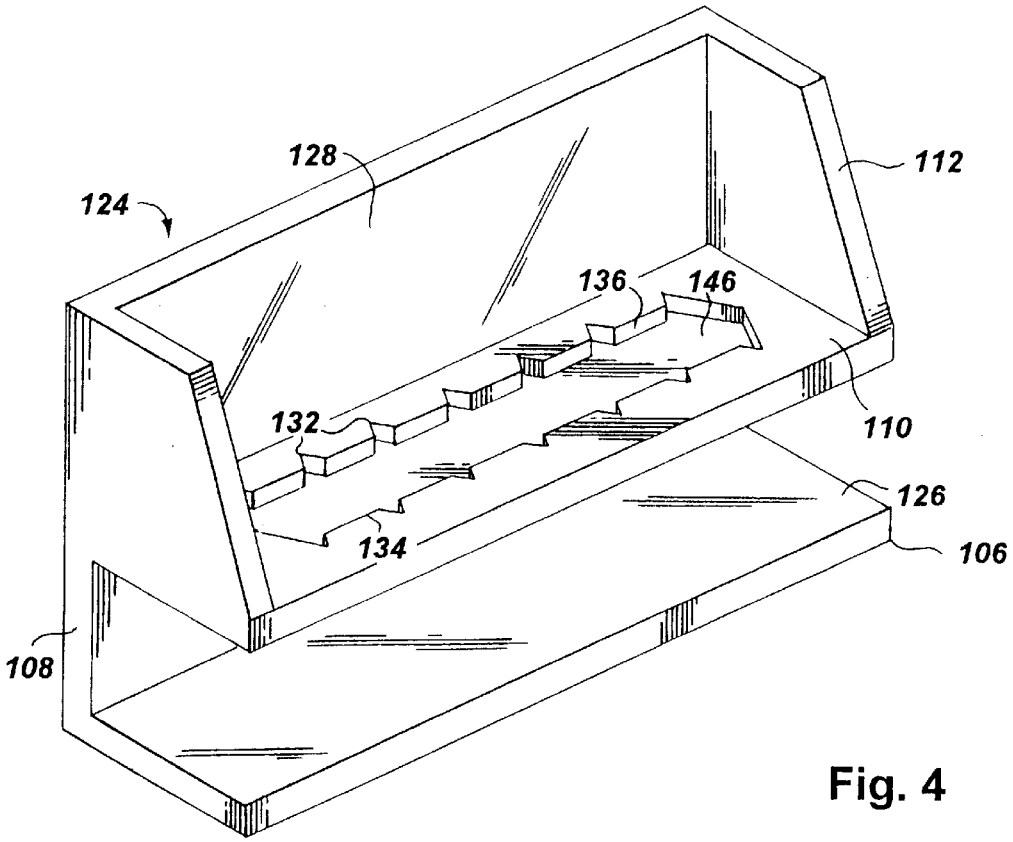
Fig. 4

CUBES AND TRAY GAME SET WITH DISPLAY MEANS

BACKGROUND OF THE INVENTION

1. Field of the Invention

This invention relates to games for the construction of English words, English phrases, Chinese terms and phrases, mathematical equations and number series, and chemical expressions on a lattice-like game board with the use of a display means. These games are not designed to be played on pre-determined patterns.

2. Description of the Prior Art

Present word games are mostly designed for the construction of English words or words using Roman letters. Such games, like the Holes model, U.S. Pat. No. 4,244,580, the Kieva model, U.S. Pat. No. 4,341,386, the Mayas model, U.S. Pat. No. 5,314,191 as well as the Beskrone model, U.S. Pat. No. 3,840,236, all have game pieces that hold only one letter each. As such, words are formed letter by letter. With such a limitation, the chance of forming a word with six or more letters is very low (no chance in the cases of the Kleva and Beskrone models).

The Japanese model (patent no. 6-261969) word game is a cross-word puzze type which requires a player to complete a predetermined group pattern of English words. Besides having the same weaknesses as the other word games mentioned, no apparatus is provided for a player to view all the faces of the game piece at a glance and thus making the search for a letter difficult. Instead, a game player must turn a group of dies in his hand for as many as twenty five times in order to select a letter. Removal of game pieces out of the game board by using fingers poses difficulty to a Caucasian or anyone having bigger fingertips. Furthermore, such a removal method makes it impossible for the fabrication of a traveler's model which necessary requires smaller dimensions. In addition, as the inserted game pieces protrude out of the game board, putting markings on the upwardly directed face of the game board for game purposes is not practical.

The Kleva word game and mathematical game are based on predetermined patterns. The model provides no means for extraction of a game piece out of the cavity of the game board.

Having noticed the weakness in forming longer English words, a study was conducted on their composition of them. In that study, fifty pages of "Webster's New Dictionary & Thearsaurus" were sampled randomly. Out of the 1,298 words sampled, more than three quarters of them consisted of six or more letters. This study has revealed the fact that most word games available today are not designed to cover the vast amount of English vocabulary.

Due to analogous reasons, prior designs are not capable of handling Chinese, Japanese and Korean characters as a large number of game pieces are required.

The present invention overcomes the above mentioned problems, with the use of cubic game pieces and game piece display means. For constructing words with six or more letters, a plurality of game pieces are used so as to hold a plurality of prefixes, suffixes, short words, letter strings, et cetera. In the case of the Chinese language game, one hundred pieces of game piece hold six hundred Chinese characters that could be used to form more than twenty five thousand Chinese terms.

However, without the display means, one would find searching for a desired indicium (a letter or a character) out of forty-two faces of seven game pieces extremely tedious. The display means allows a player to place seven game pieces in seven orientation notches that orient them for viewing. In such an orientation, three faces of each piece can be seen directly, i.e. two tilted side faces and the top face; the two rear faces can be seen in the top mirror and the bottom face can be seen in the bottom mirror. Although the mirrors laterally invert all images, the players will soon become accustomed after several rounds of the games.

In another orientation, the game pieces are aligned with the two parallel sides of the orientation slot. In this orientation, four faces of a game piece can be seen and among them the front and top faces can be seen directly, one rear face is shown in the top mirror and the bottom face in the bottom mirror. The orientation slot can take up to eight game pieces in this orientation. One major advantage is that the images are not 'tilted', thus it offers a better viewing effect. Children and old folks who are not capable of handling a large number of indicia as well as those who prefer a partial game benefit from this orientation.

An orientation mark is provided on the upwardly directed side of the lattice to help in locating the game starting position and more importantly, to identify the on-board multiple scoring markings. The starting position and multiple scoring markings are necessary in minimizing the chances of an uneven distribution of game pieces and they come with additional score incentives.

The present invention provides the following advantages over existing and similar games.

1. High capacity for indicia—this invention provides an indicia capacity as much as six times that of aforementioned games.

2. Forty-two faces in one glance—the game piece display means enables a player to view all the forty-two faces of seven cubic game pieces in one glance. Longer words, phrases and even Chinese terms or Chinese phrases can be formed easily. Options for viewing twenty-eight faces or less are available.

3. Model for travelers—the extraction means devised by the present invention make fabrication of a 'traveling' model possible since smaller dimensions do not pose extraction problems.

4. Choices of game levels—as there are six faces on each game piece, the faces can be utilized to group indicia based on the degree of difficulty in constructing words, et cetera. The players can choose from the toughest to the easiest level before a game is started or even during a game.

5. Multivariate games—making use of the six faces for grouping, a game set can be made to contain several games, e.g. word games for two languages.

6. Convenient to use—due to the structure of the game board, game pieces placed therein do not get dislocated or drop out when they encounter an external force or when the game board is placed aslant. Therefore the present invention is convenient to use even in moving vehicles.

7. Simple construction—construction of the invention is simple. It is easy and not costly to fabricate.

BRIEF DESCRIPTION OF THE DRAWINGS

FIG. 2*a* is the cross-sectional view of a lattice with separable base member attached;

FIG. 2*b* is the cross-sectional view of a compartment board similar to FIG. 2*a* except that the base member is inseparable and having rows and columns of extraction holes.

DESCRIPTION OF THE PREFERRED EMBODIMENTS

Figure 1:
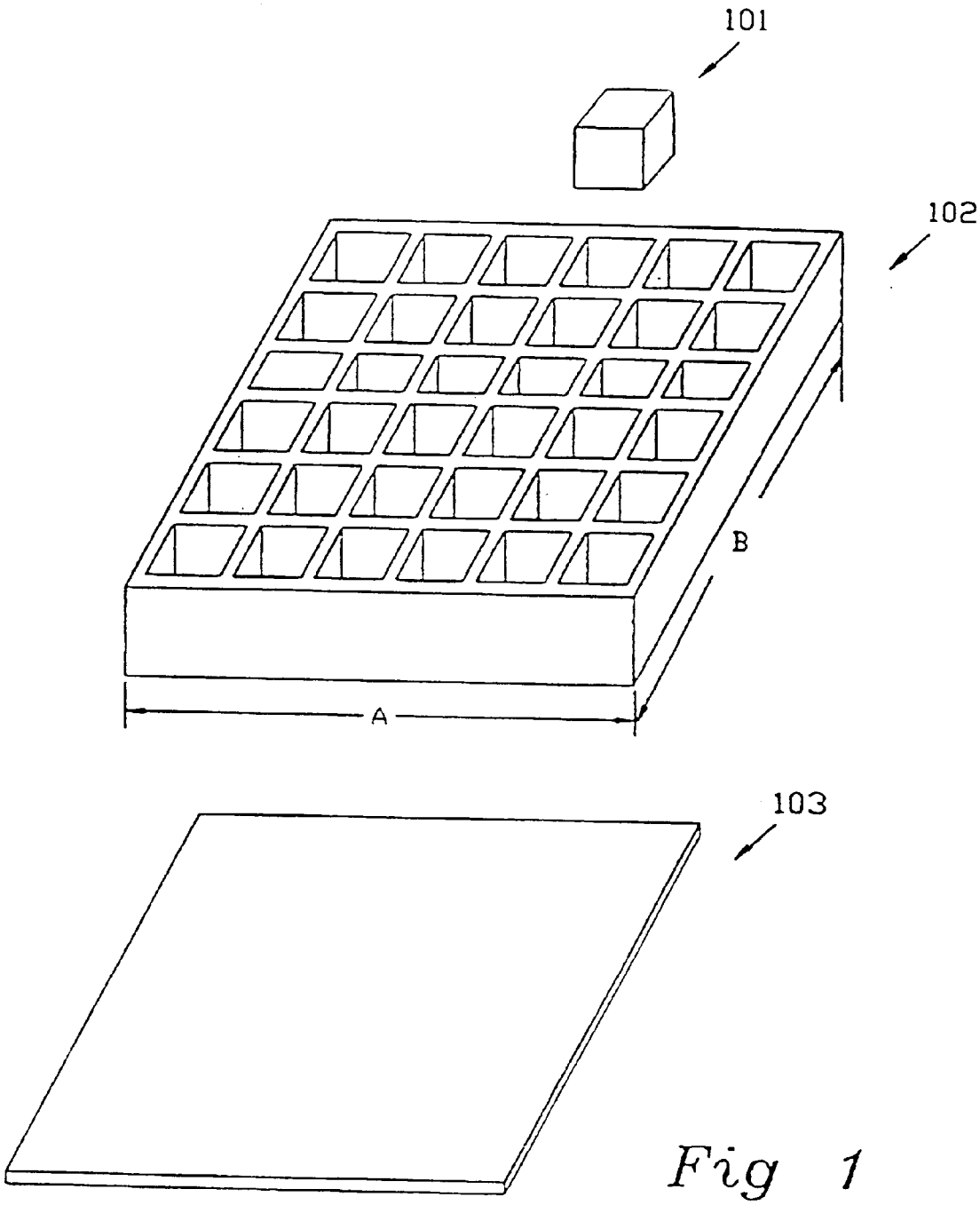
FIG. 1 is the perspective view of the cubic game piece, lattice and base member.
Figure 3:
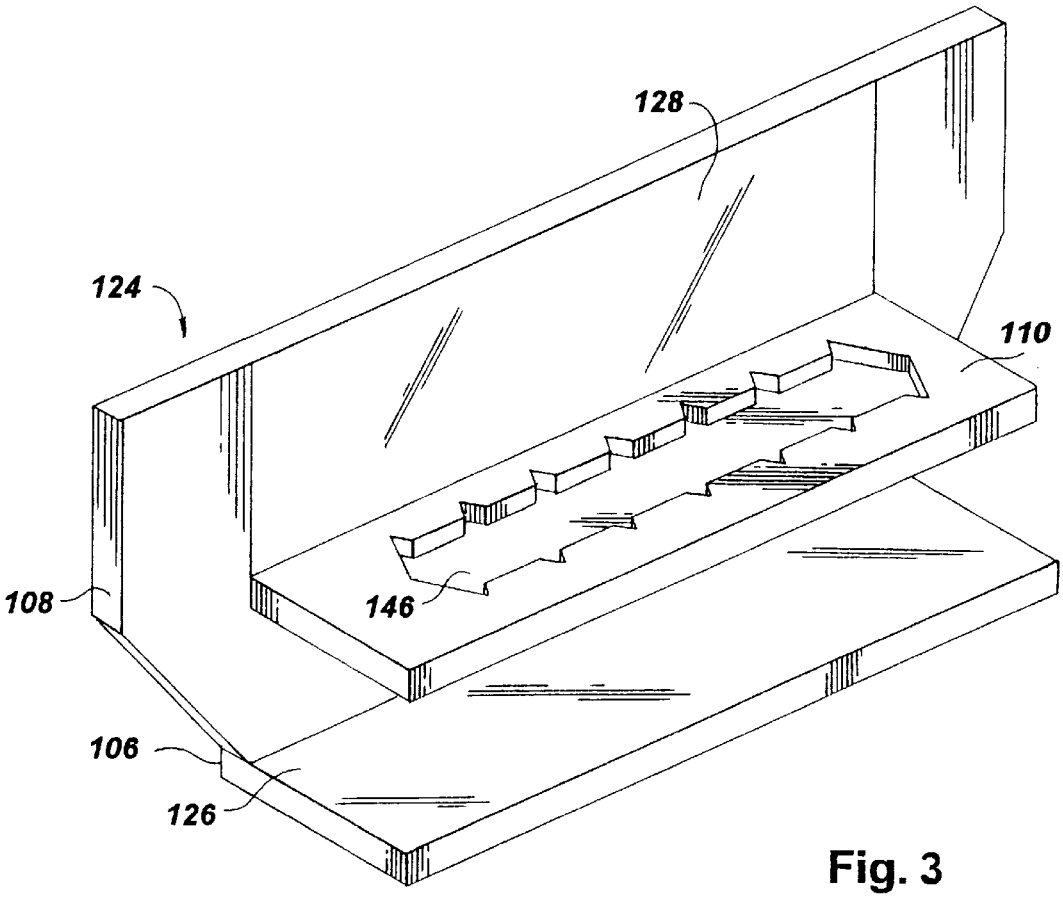
FIG. 3 is similar to FIG. 4 except that the two side covers are not provided while the back panel is lengthened without affecting the size of the top mirror.

As shown in FIG. 1 and in FIG. 4, game piece 101, lattice 102, base member 103, back panel 108, holder 110 and side cover 112 are preferably made of plastic. The quantity of game piece 101 allocated for a game is not directly referred to the number of compartments 114.

In this embodiment, an English word game, utilizes one hundred cubic game pieces with a majority of their faces each bearing one of the following types of indicia:—a short word (e.g. "man", "he"), prefix (e.g. "abs"), suffix (e.g. "tion"), word composition element (e.g. "acet", "poly"), letter string (e.g. "th", "br", "st") and single letter (e.g. "a", "p"). There are in total six hundred indicia.

Lattice 102 is a square object having 15×15 square compartments 114 whose individual size is just right for a game piece 101 to be placed fully inside. While remaining inside said compartments, the upwardly directed face of each game piece is flush with that of lattice 102 and in addition, five faces of each game piece 101 are hidden, exposing only the upwardly directed face. Said game pieces 101 are arranged either in transverse or longitudinal manner in each move of the game, and in compartments 114 side by side to form valid English words.

The base member 103, having the same planar size of lattice 102, is placed under lattice 102 for holding of all game pieces 101 placed thereon.

In said embodiment, lattice 102 and base member 103 are separable and they can be assembled together for ease of extraction of game piece 101. In another embodiment, the lattice and base member can be made non-separable into one integral object as illustrated in FIG. 2(*b*). The base member having rows and columns of holes 116 whose positions correspond to said rows and columns of compartments 114 and each having a size that allows one human finger to go through for purpose of game piece extraction.

In yet another embodiment, lattice 102 and base member 103 are non-separable while base member 103 having no hole thereon. Stickers made of a variety of materials can be used for extraction purpose. To extract a game piece out of the compartment 114, firmly stick a piece of sticker on the exposing face of the game piece to be extracted, pull said game piece out of the compartment.

Figure 5:
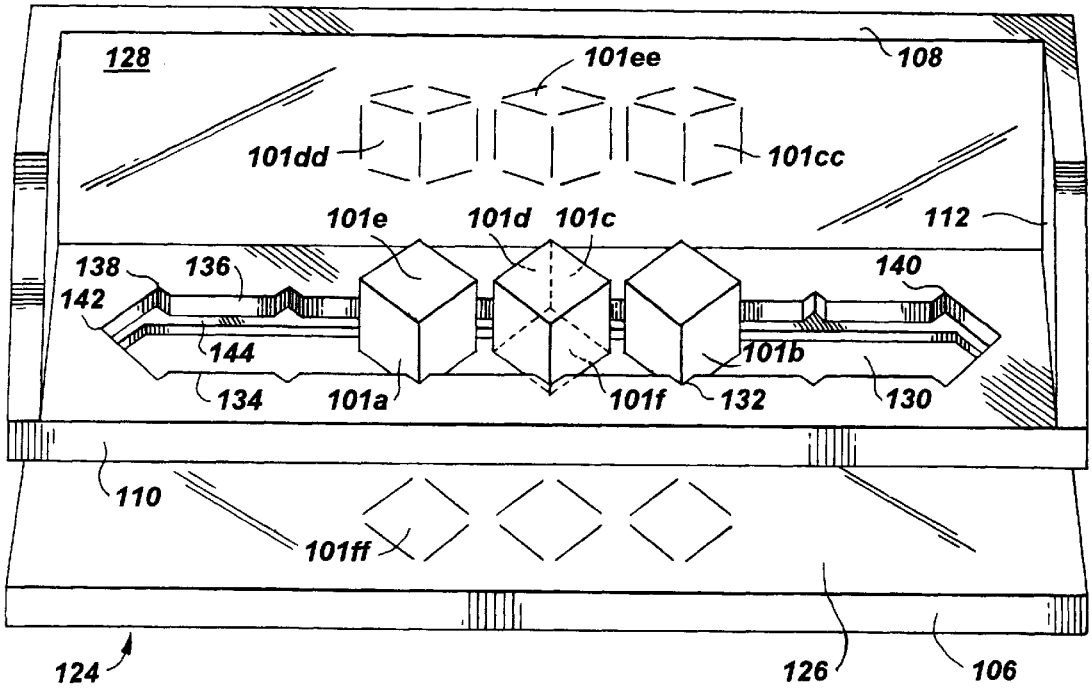
FIG. 5 illustrates in perspective view another embodiment of the game piece display means similar to FIG. 4 except that an orientation slot is shown instead of an orientation recess. The figure also illustrates in perspective view the sight of a game player looking at the display means from the front of it. The figure shows that the orientation slot holds three game pieces which are being supported by protrusions and each game piece is enclosed by a pair
Figure 6:
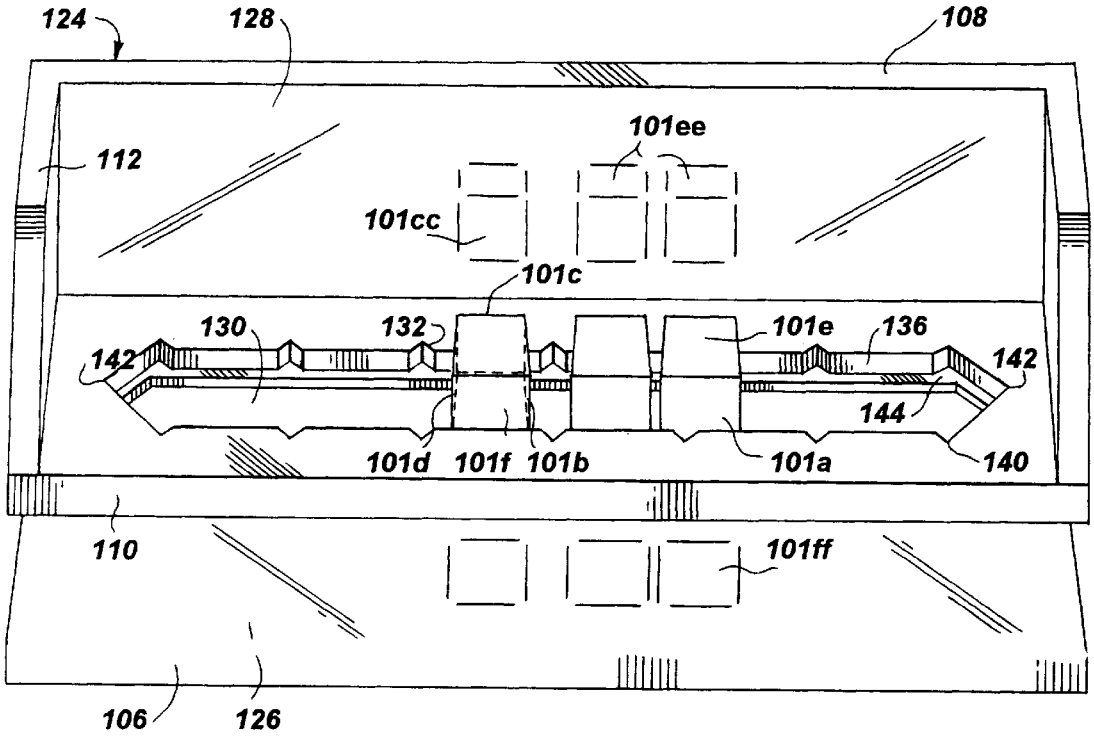
FIG. 6 is similar to FIG. 5 except that the three game pieces are held inside and aligned with the orientation slot. Such an orientation enables viewing of the four faces of each game piece.
Figure 7:
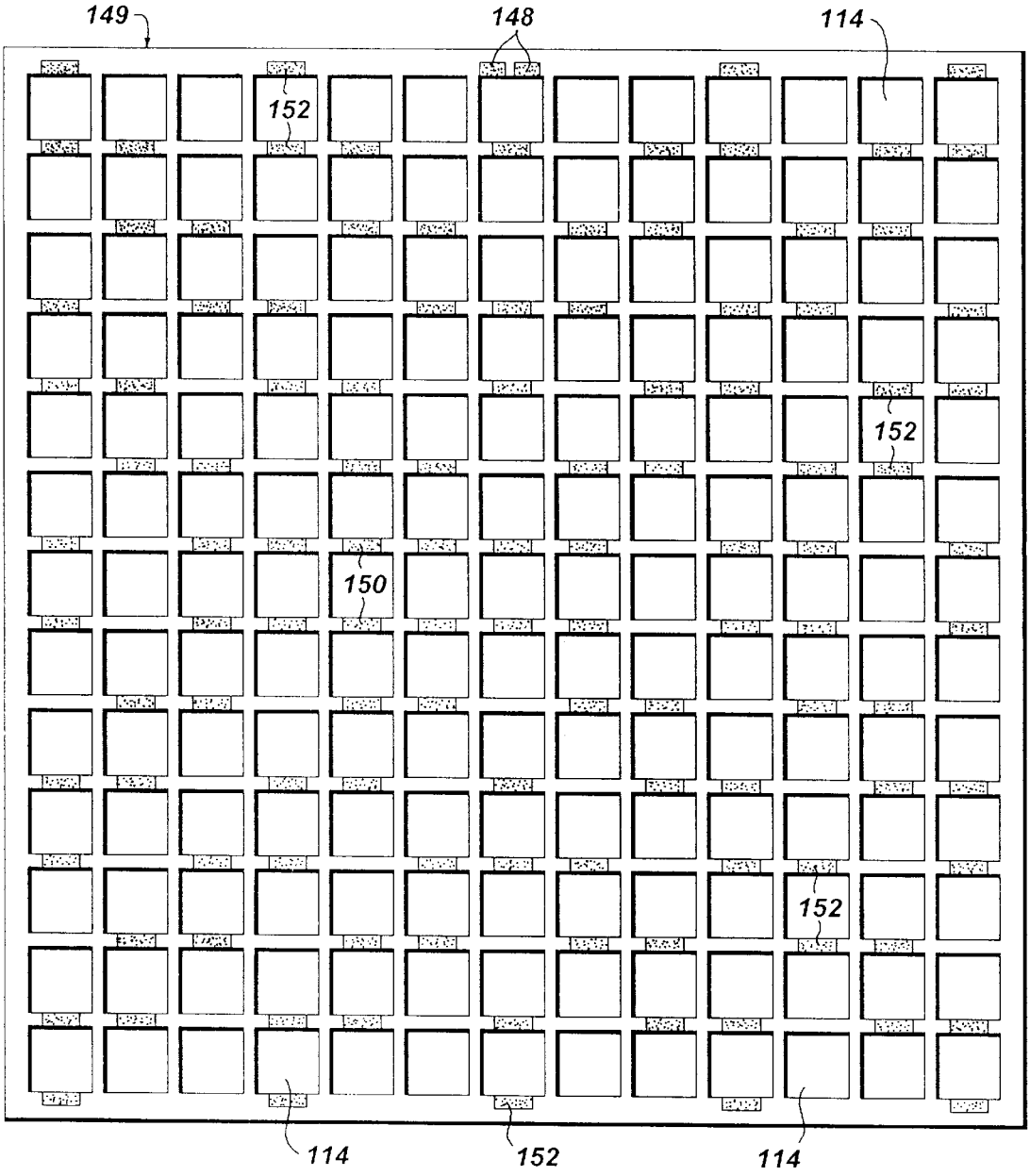
FIG. 7 illustrates the lattice in plan view with markings thereon.

In order to assist players in locating desired indicia in a more convenient way, the present invention is providing a game piece display means 124 as depicted in FIGS. 4, 5 and 6. By using said display means, all six faces of a game piece can be seen clearly at a glance.

FIGS. 5 and 6 show an embodiment of game piece display means 124. Said display means comprising a base member 106 which is substantially rectangular and whose upwardly directed surface is a bottom mirror 126, a rectangular back panel 108 positioned horizontally and extended upwardly above said mirror at an angle adjacent to and along a long side of said bottom mirror and having a rectangular top mirror 128 positioned on its upper side and above said bottom mirror 126, a rectangular game piece holder 110 positioned horizontally and extended horizontally adjacent to the lower side of said top mirror and above said bottom mirror; and two rectangular side covers 112 each positioned vertically and extended upwardly adjacent to and along a short side of said game piece holder respectively.

Along the length of said game piece holder 110, an orientation slot 130 is provided with one right-angle end notch 142 at each end. The end notches are furthest apart from and opposite each other but connected by two mutually parallel straight edges 134 and 136 along which a set number of pairs of right-angle orientation notches 132 are provided at equal intervals; said orientation notches pointing away from the axis of symmetry of said slot; one side of each said notch forming an angle with the adjacent slot edge at about 135 degrees. The lower portions of said parallel edges and the lower portions of the edges of said notches having protrusions 144 which protrude horizontally towards the axis of symmetry of said orientation slot.

Figure 9A:
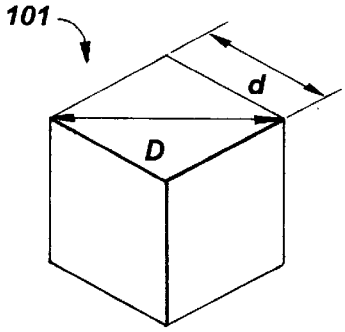
FIG. 9*a* illustrates the dimensions of a game piece in perspective view.
Figure 9B:
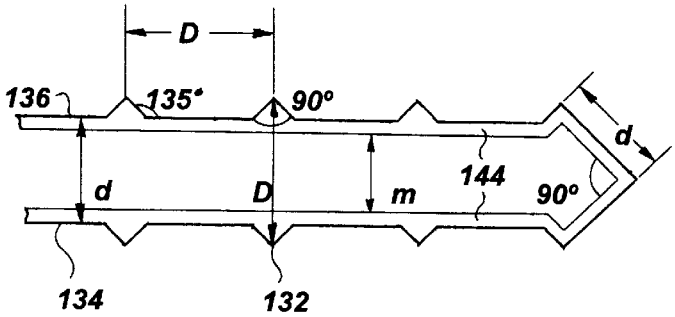
FIG. 9*b* illustrates the dimensions of the orientation slot in plan view.

In addition, as illustrated in FIGS. 9*a* & 9*b*, the distance between the two vertices of said pairs of orientation notches are longer than the length D of the diagonal of the face of said game piece such that the space so provided at two adjacent pairs of said notches is sufficient to receive two said game pieces and each game piece fits in the space enclosed by each pair of notches respectively; in addition, the distance between said two parallel edges is longer than the length d of said side of said face of said game piece such that said game piece fits in the space between said two parallel edges and that said protrusions remain effective in holding said game piece while the indicium on the downwardly directed face of said game piece can be seen without obstruction; further to that, the length of each long side of each said end notch is longer than the length d of said side of said face of said game piece such that the game piece fits in the space enclosed by said end notch.

When using the display means for a game a player may, as shown in FIG. 5, place at most seven game pieces in an orientation slot in a diagonal position with respect to the player who faces the display means, i.e. allow a game piece be positioned in the slot such that two diagonally faced corners of it are enclosed by a pair of notches 132; and allow the protrusions that run along the orientation slot edges to hold the game pieces rested thereon, i.e. allow face 101*f* which is directed downward to rest on the upwardly directed surface of said parallel protrusions. In such orientation said player not only sees the upwardly directed face 101*e* and its two adjacent faces 101*a* & 101*b* in direct view, through reflection at the bottom mirror 126, said faces 101*f* can also be seen. In addition to this, two rear faces 101*c* & 101*d* of said game piece can be seen through reflection at the top mirror 128. The 101*cc*, 101*dd* and 101*ff* are mirror images of the game piece faces 101*c*, 101*d* and 101*f* respectively. Therefore, said player has a clear view of all six faces of each game piece. If seven game pieces are employed, in total forty two faces can be viewed at a glance without having to turn the game pieces one by one in the player's hands. This facilitates easy memorization of all the indicia by the player and he thus able to choose, quickly and conveniently pick up the desired game piece for construction of words. This will definitely make playing word games more enjoyable and fun.

The two side covers 112 at either end of game piece holder serve to prohibit players who are sitting at the rear side of the display means from looking into the orientation slot. For the convenience of fabrication as well as lower cost, said side covers are not provided while the length of said back panel 108 is adequately extended to achieve a similar effect.

Other than the above orientation, a player can orient a game piece to align with the orientation slot edges 136 and 134. In such an orientation, the orientation slot can receive at most eight game pieces in this embodiment. With the use of the bottom mirror and top mirror, said orientation allows four faces for each game piece to be seen. The four faces being 101*a*, 101*c*, 101*e* and 101*f*. The 101*cc* and 101*ff* are mirror images of 101*c* and 101*f* respectively.

What makes the difference is that all said four faces are oriented without being 'tilted' with respect to said player. Therefore it provides a better visual effect as compared to the other orientation. This orientation is especially helpful for players such as children, old folks and any others who do not want to handle large amounts of indicia, or be distracted by unwanted indicia or both.

As illustrated in FIGS. 5, 6 & 9*b*, the lower portions of slot edges 136 and 134 of the game piece holder are provided with protrusions 144. Game pieces that are placed in the orientation slot are held by said protrusions. The faces 101*f*, which are directed downward, are kept in parallel with the bottom mirror 126. In the embodiment for which protrusions are not provided, transparent means shall be provided not only for holding said game pieces but also for viewing through the bottom mirror.

In another embodiment, the orientation slot is replaced by an orientation recess 146 which is illustrated in FIG. 4. The face 101*f* of the game piece can be rested entirely into said recess. The structures of said bottom mirror, back panel and game piece holder are the same as those shown in FIG. 5. Material used for said recess or said holder having said recess shall be transparent so that viewing of face 101*f* becomes possible.

In yet another embodiment, the game piece holder is provided without an orientation slot or orientation recess but with upright orientation protrusions or guides on its upwardly directed side. The profile of said upright protrusions looks similar to that of the orientation slot. Material used for such holder shall be transparent.

To start playing a game, it is easier to first locate the board orientation marking 148 provided in the compartment board 149 before locating the game starting position marking 150. The board orientation marking is positioned on the upwardly directed side of the lattice perimeter. The multiple score marking 152 comes in pairs of longitudinal color bars scattered all over the lattice. Player who places a game piece in between two said bars will have his score increased in accordance with individual game rules. For the English word game, 'double letter score', 'triple letter score', 'double word score' and 'triple word score' are used. Game starting position marking and multiple score markings are essential in prevention of an uneven distribution of game pieces.

Figure 8A:
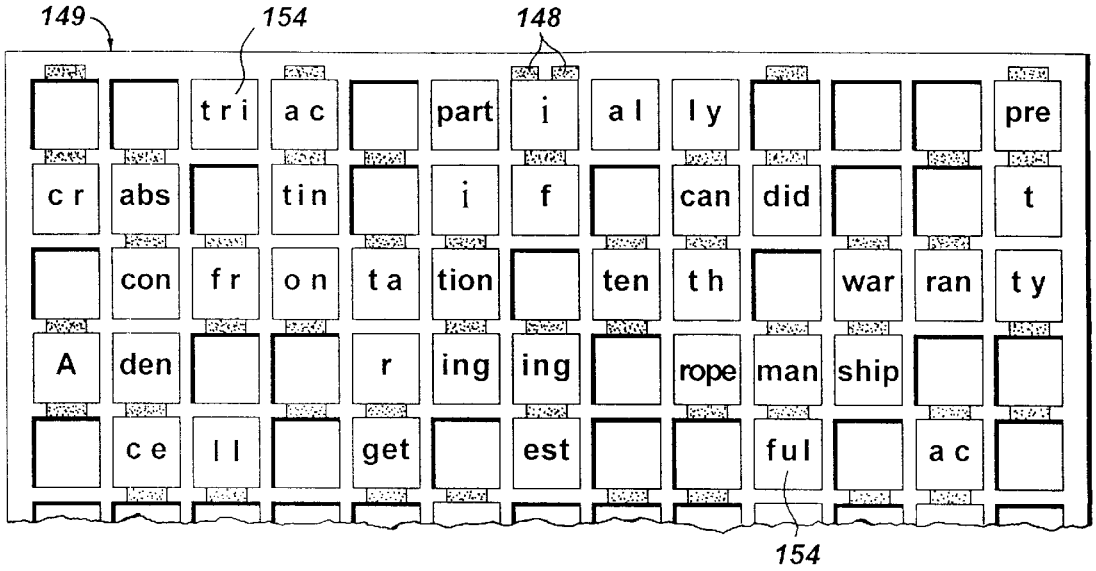
FIG. 8*a* illustrates in plan view the English word game played with the present apparatus.

The variety of games that can be played with the present invention:

English word game :—as shown in FIG. 8*a*, the English word game played with the present apparatus makes use of a large number of short words, prefixes, suffixes, composition elements, letter strings and single letters, all of that consist of four or less letters. They are represented by indicium 154. Longer words can be formed easily with this game.

Figure 8B:
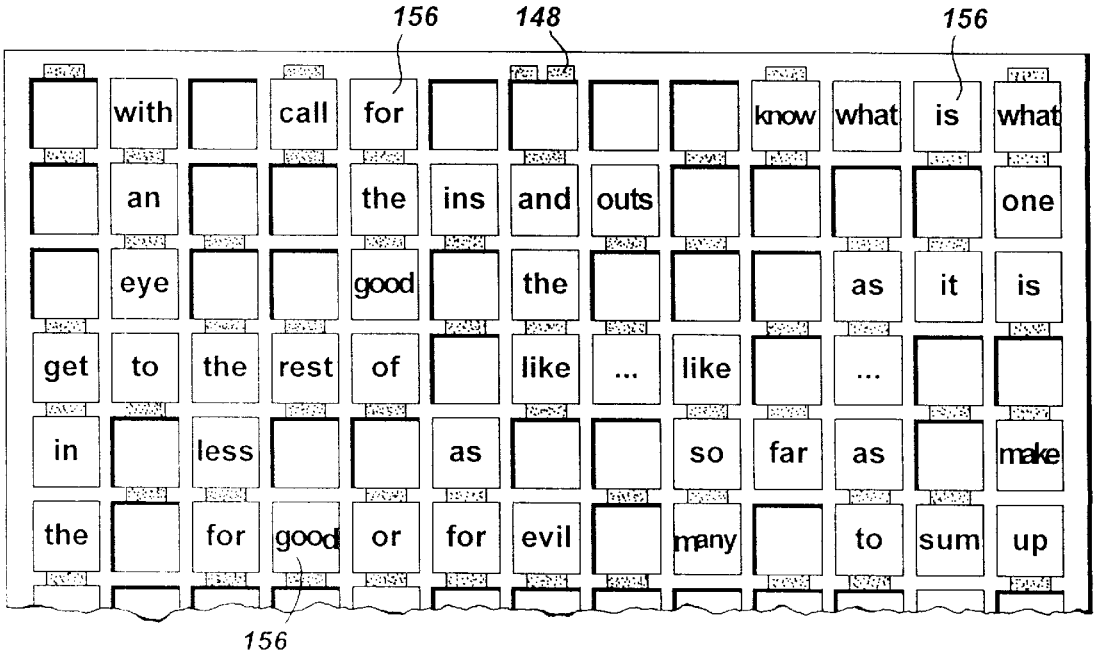
FIG. 8*b* illustrates in plan view another embodiment for the game, the English idiom and phrase game played with the present apparatus.

English idiom and phrase game :—as shown in FIG. 8*b*, a plurality of English idioms and phrases can be formed with the present invention. Indicium 156 shows one of the required words.

Figure 8C:
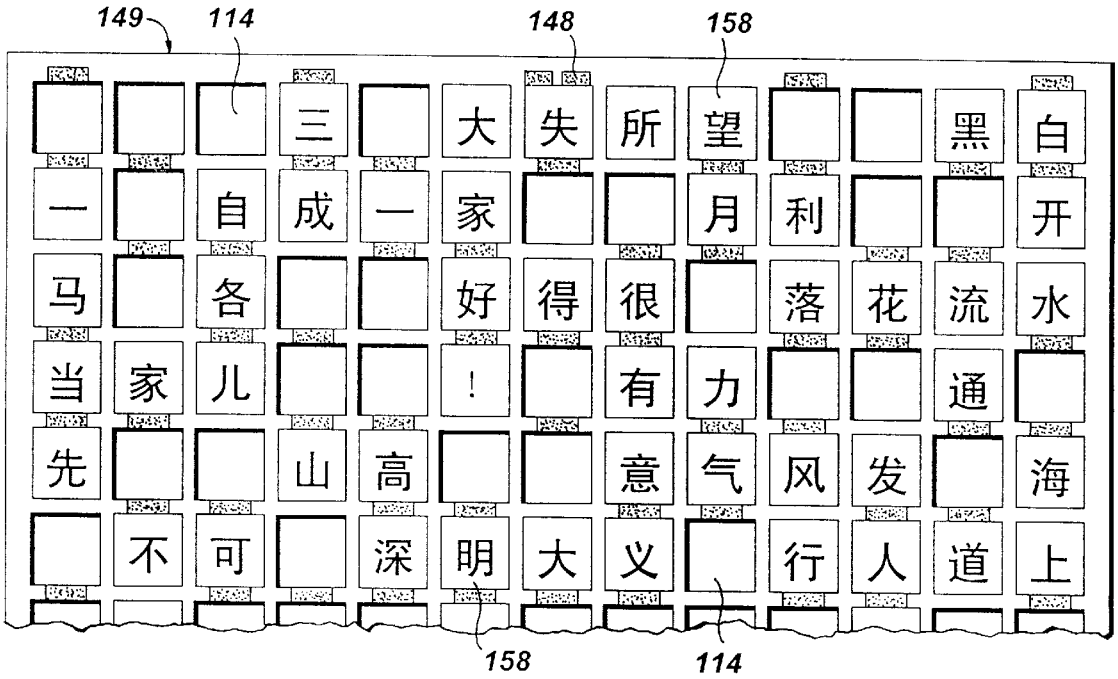
FIG. 8*c* illustrates in plan view another embodiment for the game, the Chinese term and phrase game played with the present apparatus.

Chinese term and phrase game :—the present invention allows a game for Chinese characters too. FIG. 8*c* illustrates the partially concluded game and indicium 158 is a typical Chinese character. About four hundred Chinese characters are used for the construction of up to 25,000 terms. Chinese proverbs can be constructed utilizing a different scoring method.

Figure 8D:
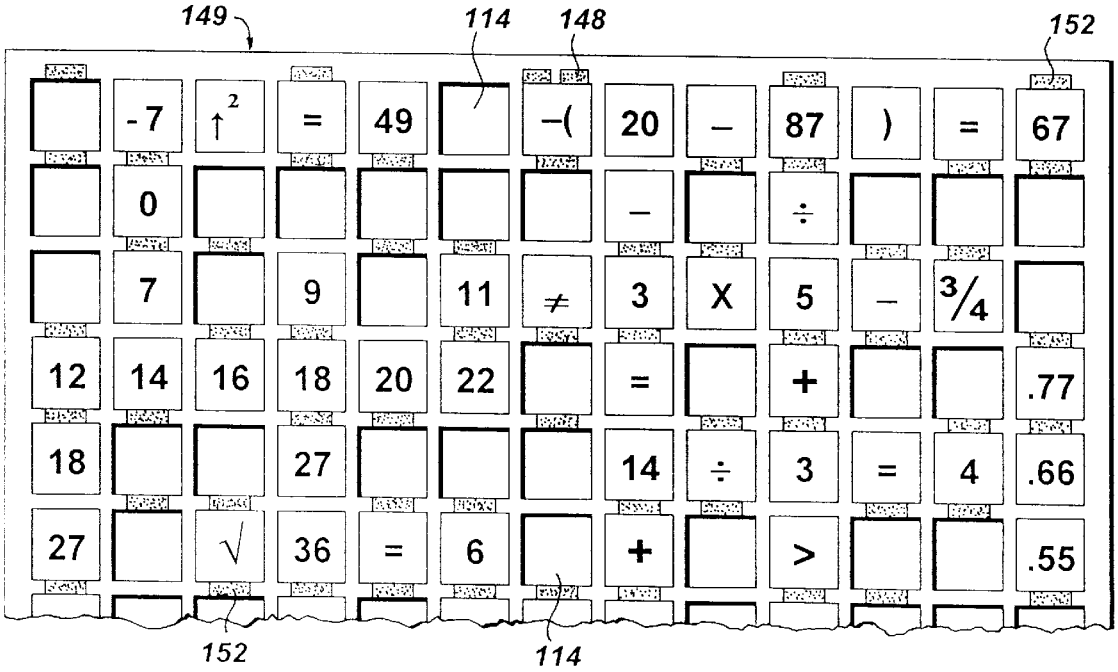
FIG. 8*d* illustrates in plan view another embodiment for the game, the mathematical expression and number game played with the present apparatus.

Mathematical equation and number game :—FIG. 8*d* shows that a game based on mathematical equations and number series is possible with the present apparatus. Inequalities are also included.

Figure 8E:
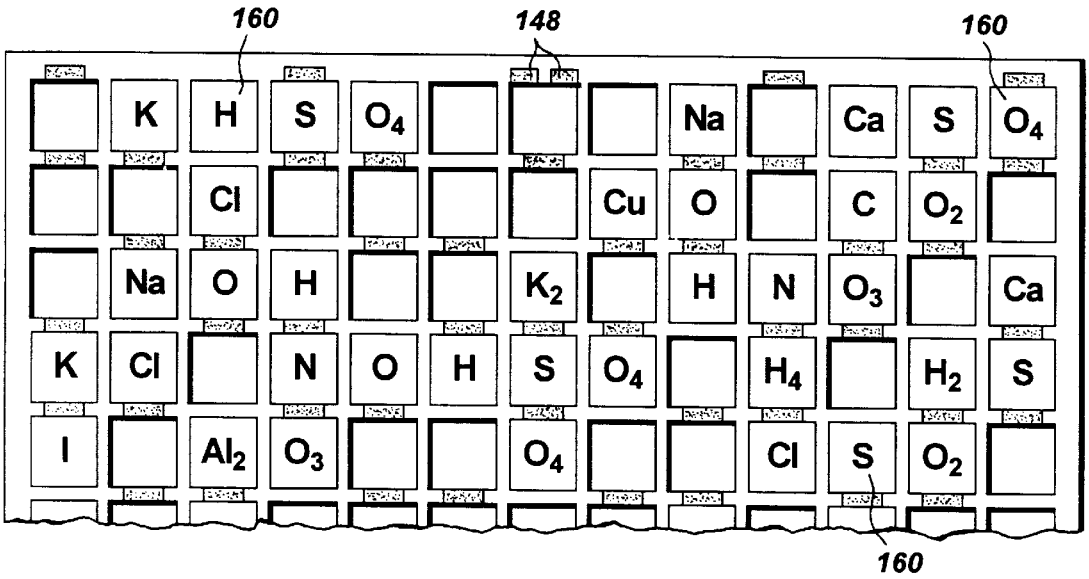
FIG. 8*e* illustrates in plan view another embodiment for the game, the chemical expression game played with the present apparatus.

Chemical expression game :—as illustrated in FIG. 8*e*, chemical expressions can be constructed with the present invention. Indicium 160 represents a chemical element.

What is claimed is:

1. A board game apparatus comprising a game board, a display means and a plurality of cubic game pieces; said game board comprising a rectangular base member and a lattice attached thereon; said lattice having rows and columns of compartments whereby each compartment is adapted to retain a respective said cubic game piece fully and having an upwardly directed surface where markings are provided for game purpose; said base member having rows and columns of holes whereby each said hole is positioned to align with a respective said compartment and adapted for a human finger to pass through for the extraction of said game piece from said compartment placed therein; said display means comprising a rectangular bottom mirror positioned horizontally and extended horizontally, a rectangular back panel positioned horizontally and extended upwardly above said mirror at an angle adjacent to and along a long side of said bottom mirror, a rectangular top mirror positioned horizontally and extended downwardly at an angle adjacent to and along the upper side of said back panel and above said bottom mirror, a rectangular game piece holder positioned horizontally and extended horizontally adjacent to and along the lower side of said top mirror and above said bottom mirror; and two rectangular side covers each Positioned vertically and extended upwardly adjacent and along a short side of said game piece holder respectively; said cubic game piece having six faces where indicia are provided.

2. The board game apparatus set forth in claim 1 characterized in that along the length of said game piece holder, an orientation slot is provided with one right-angle end notch at each end; said end notches are furthest apart from and opposite each other but connected by two mutually parallel straight edges along which a set number of pairs of right-angle orientation notches are provided at equal intervals; said orientation notches pointing away from the axis of symmetry of said slot and one side of each said notch forming an angle with the adjacent slot edge at about 135 degrees; the lower portions of said parallel edges and the lower portions of said sides of said notches having protrusions which protrude horizontally towards the axis of symmetry of said orientation slot.

3. The board game apparatus set forth in claim 1 characterized in that along the length of said game piece holder, an elongated orientation recess is provided with one right-angle end notch at each end; said end notches are furthest apart from and opposite each other but connected by two mutually parallel straight edges along which a set number of pairs of right-angle orientation notches are provided at equal intervals; said orientation notches pointing away from the axis of symmetry of said slot; one side of each said notch forming an angle with the adjacent slot edge at about 135 degrees.

4. The board game apparatus set forth in claims 2 or 3 characterized in that the distance between the two vertices of said pairs of orientation notches are longer than the length D of the diagonal of the face of said game piece such that the space so provided at two adjacent pairs of said notches is sufficient to receive two said game pieces and each said game piece fits in the space enclosed by each said pair of notches respectively; the distance between said two parallel edges is longer than the length d of said side of said face of said game piece such that said game piece fits in the space between said two parallel edges and that said protrusions remain effective in holding said game piece while the indicium on the downwardly directed face of said game piece can be seen without obstruction; the length of each long side of each said end notch is longer than the length d of said side of said face of said game piece such that the game piece fits in the space enclosed by said end notch.

5. The board game apparatus set forth in claim 2 characterized in that the distance m between said parallel protrusions along said parallel slot edges is shorter than the length d of said side of said face of said game piece such that said protrusions remain effective in holding said game pieces placed thereon while the indicium on the downwardly directed face of said game pieces can be seen without obstruction.

6. The board game apparatus set forth in claim 1 characterized in that said side covers are not provided while the length of said back panel is sufficient to prohibit the game players sitting at the rear side of said display means from seeing said game pieces placed on said display means.

* * * * *